United States Patent [19]

Stephens

[11] Patent Number: 4,955,274

[45] Date of Patent: Sep. 11, 1990

[54] VIOLINS

[76] Inventor: Joseph H. Stephens, Coker Court, The Tudor Wing, East Coker, Yeovil, Somerset BA22 9JW, England

[21] Appl. No.: 263,028

[22] Filed: Oct. 26, 1988

[51] Int. Cl.[5] ..... G10D 1/02

[52] U.S. Cl. ..... 84/275; 84/291; 84/452 P

[58] Field of Search ..... 84/275, 291, 452 P

[56] References Cited

U.S. PATENT DOCUMENTS

| | | | |
|---|---|---|---|
| 3,699,836 | 10/1972 | Glasser | 84/291 |
| 3,880,040 | 8/1975 | Kaman | 84/291 |
| 4,408,516 | 10/1983 | John | 84/275 |
| 4,836,076 | 6/1989 | Bernier | 84/275 |

*Primary Examiner*—Lawrence R. Franklin

*Attorney, Agent, or Firm*—Plante, Strauss, Vanderburgh & Connors

[57] ABSTRACT

The invention relates to the manufacture of a violin (and other instruments of the violin family), in which the component parts of the acoustic box are made from sheet material. The sheet material is composed of substantially unidirectionally oriented man-made fibres, for example of carbon or boron, set in a matrix of epoxy resin. Thus the fibres are substantially all aligned from end to end in the front plate and in the back plate, we well as in the lengths of the side pieces and bass bar. Using this alignment of fibres that have a high modulus of elaticity, coupled with relatively low specific gravity and low flexural friction in vibration, a design for an instrument's acoustic box is specified which provides for instruments having vibrational systems, similar to that found in traditional instruments, but in which, for the same loudness of sound propagated, there are substantial economies in the proportional of force inherent in a vibration that is deployed in propagating sound.

11 Claims, 6 Drawing Sheets

VIOLINS

BACKGROUND OF THE INVENTION

Embedded in the technology that is fundamental to this invention is cognizance that the running waves that develop in the vibrating strings of a violin (a natural phenomenon) are proportionately representative, and the sole precursor, of the vibratory modes of the sound propagated. This acquired knowledge is in contradiction and refutation of the commonly held assumption that the phenomenon of "plate Resonance" (as first demonstrated by Prof. Chladni) is fundamental to the function of a violin.

This invention relates to violins and is particularly concerned with the manufacture of violins.

As used herein, the term "violin" is intended to include other instruments of the violin family, which are variations, mainly in size, of a violin. Thus "violin" as used herein, includes a viola, a cello and a double bass and refers to instruments both of standard and student size. For simplicity, the description of the invention given in this specification refers to a violin.

The construction of a violin has changed very little since the 16th century. The construction and parts of a violin are described in detail in, for example, "Violins and Violinists" by Franz Farga, published by Barrie & Rockliff, Cresset Press, London, 2nd Edition 1969—see especially Plate XXII and the accompanying description.

In essence, a violin comprises an acoustic box, a neck and tail piece, with strings tensioned between the neck and the tail piece, and extending over a bridge component, the bridge being in contact at two points (or feet) with the front or top plate of the acoustic box. Its overall dimensions (within narrow limits), general appearance, material specification, have by what is now long tradition, become subject to standardisation.

A violin comprises a unified system of elasticity. The vibrational system is identified by the coefficients of elasticity in the structure, on which the strings are mounted, in respect of bending and torsion. Excellence in an instrument's potential for musical performance is related, in the main, to these attributes of elasticity and, in particular, to that proportion of energy that is dissipated in overcoming friction in the strings and in those flexions in the body structure that propagate sound.

A violin's potential for musical performance varies from that which in an instrument made by 'Cottage Industry Manufacture' is very poor, to that which in a few instruments made in a past epoch, is superb. In the hands of the virtuosi the musical potential of those few instruments is said to be second only to that of the human voice.

By every feature of the design of a violin it is, for its weight, remarkably stiff in respect of its resistance to bending from the force in string tension that acts at the nut, saddle and the foot of the bridge that rests above the sound post. Force however, that acts at the foot of the bridge resting above the bass bar produces a substantial degree of flexure in that area of the front plate that lies between the sound holes and in the structure as a whole. With the strings in vibration it is those torsional vibrational amplitudes that develop in the front plate and in the structure as a whole that are the main source of propagated sound.

Using a violin of known excellence in musical potential, measurements of elasticity have been recorded as follows:

Bending in the structure from the force in string tension acting at the nut, saddle and the foot of the bridge that is above the sound post, measured at the joint of the neck with the body structure, was found to be in the order of 0.35 m/m.

Torsional flexure from the static force in string tension requires to be measured as it is present at the bass foot of the bridge and in the structure as a whole. Accurate measuring was found to be impractical. Instead, the elastic properties of the plates were measured and recorded as follows: torsional elasticity in the top plate (including bass bar and sound holes), measured from one end of the plate to the other, was found to be in the order of a torque of 2.58 kgm/cms per degree of flexure. Torsional elasticity in the back plate was found to be in the order of 3.76 kgm/cms per degree of flexure.

The weight of the component parts is given as follows:

| | |
|---|---|
| Front plate including bass bar | 80 gms |
| Back plate | 95 gms |
| Rib assembly | 55 gms |
| Total weight of assembled instrument | 440 gms |

SUMMARIES OF THE PRESENT INVENTION

According to one aspect of the present invention, a violin is manufactured by fabricating the acoustic box comprising a front plate, a back plate, side pieces joining the front plate to the back plate, and, mounted within the acoustic box, a bass bar, all fabricated from sheet material composed of substantially unidirectionally oriented man-made fibres set in a matrix of resin, the alignment of the fibres being substantially parallel to the central, longitudinal axis of the acoustic box.

By "substantially unidirectionally" with respect to man-made fibre orientation, is meant up to 18°. A sparse distribution of randomly oriented fibres may be included so as to further reduce any tendency of the components of the acoustic box to split during manufacture.

The violin may be provided with a sound post of traditional, i.e. not man-made, material. Alternatively, the sound post may comprise a tube of fibre-reinforced resin, the fibres extending lengthwise along the post.

There are man-made fibres set in a matrix of epoxy resin commercially available in sheet form. These materials have a substantially higher modulus of elasticity/specific gravity quotient ($GN/m^2 \div$ Specific Gravity), sometimes referred to as Specific Modulus, than is found in either spruce or acer, (which are traditional materials), e.g. at least 50 and preferably in excess of a 100. An example of carbon fibre sheet material that may be used in the present invention is "GRAFIL" HM-S. ("GRAFIL" is a Registered Trade Mark of Courtaulds plc). "GRAFIL" HM-S has physical properties as follows:

| | |
|---|---|
| Specific gravity | 1.6 |
| Ultimate tensile strength | 1.3 GN/N |
| Young's modulus | 190 GN/M |

Young's modulus/specific gravity quotient for both spruce and acer is of the order of 20.

Boron fibre sheet material is one alternative to carbon fibre sheet material.

These materials are capable of sustaining vibrations nearly four times as long as those sustained by either spruce or acer in similar tests.

According to another aspect of the invention, a violin is manufactured whereby the weight of material that contributes to the required coefficients of elasticity in respect of bending and torsion, is concentrated substantially on the central axis of the box. In this way the centres of mass in the flanks in the upper and lower bouts of the acoustic box are brought nearer the central axis thus obtaining, for a given level of loudness, a reduction in vibratory amplitudes as measured at these mass centres together with a corresponding reduction in the proportion of available energy that is necessary to the development of each partial in the wave form of the vibratory mode.

In one embodiment of the invention, the required coefficients of elasticity can be achieved by fabricating the front and back plates of the acoustic box with a build-up of shaped laminations that substantially concentrate weight on the central longitudinal axis thereof. There will be corresponding economies in the deployment of energy.

In another embodiment of the invention, these economies in the deployment of available energy are achieved by the use of reinforcing pieces distributed along the central axis of the plates from one end of each to the other thereof. They are secured to the plates, for example, by adhesive.

In both of these embodiments of the invention, using sheet material for the fabrication of the acoustic box that is a matrix of resin and fibre similar to "GRAFIL" HM-S (or that which is even more suited to the purpose), there will be a reduction in the proportion of energy dissipated in overcoming flexural friction in the structure and a corresponding reduction in the call on available energy. In explanation of the factors controlling vibration amplitudes (and in doing so establish a call on the energy available in a vibrating string, in a process of reciprocity), it will be appreciated that in a vibrational system of resonance and energy conservation, equilibrium will be maintained at nut, saddle and bridge feet. It is in the maintenance of these conditions of equilibrium that flexions develop in the structure that are of specific amplitude.

Each of these embodiments of the invention provide violins that will have an improved potential (as compared with traditional instruments) for a musical performance that is specified as follows:

(1) A greater immediacy of response to the player's technique in bowing and fingering the strings.

(2) Greater variety in the number and amplitude of the overtones that are present in the sound that can be developed by the player in giving expression to the music.

(3) Greater 'carrying power' and potential for loudness in the sound propagated.

BRIEF DESCRIPTION OF THE DRAWINGS

The various aspects of the invention will now be described by way of example only, with reference to the accompanying drawings, wherein.

DETAILED DESCRIPTION OF THE PREFERRED EMBODIMENT

Figure 7:
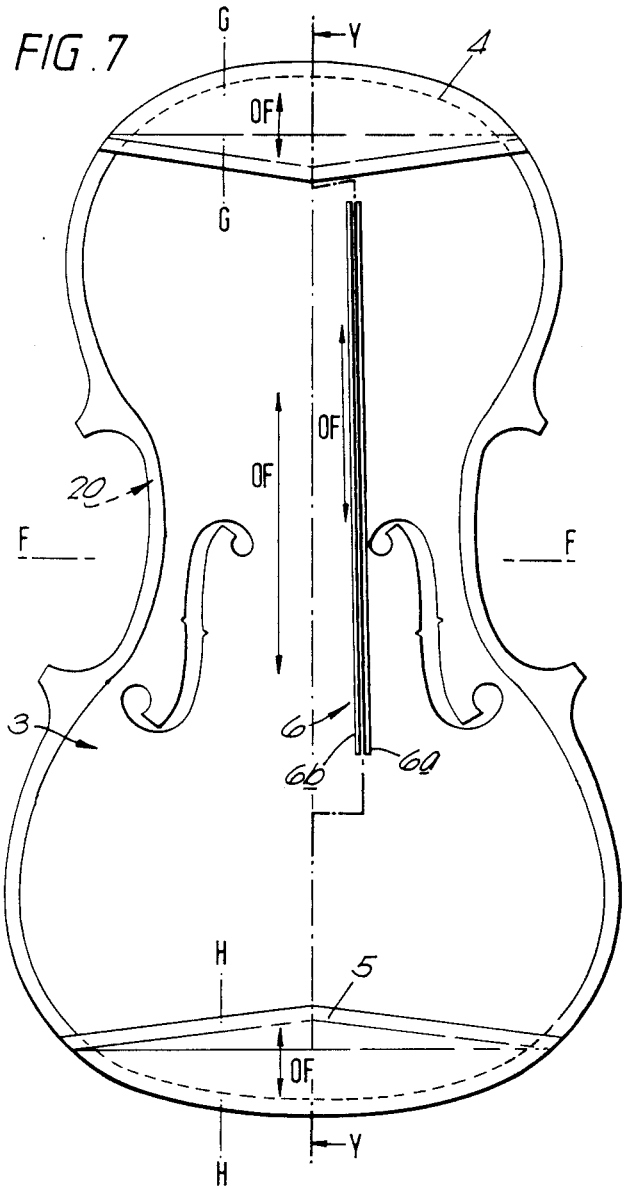
FIG. 7 is a view of a sub-assembly comprising the front plate of the violin, viewed from inside the acoustic box.
Figure 8:
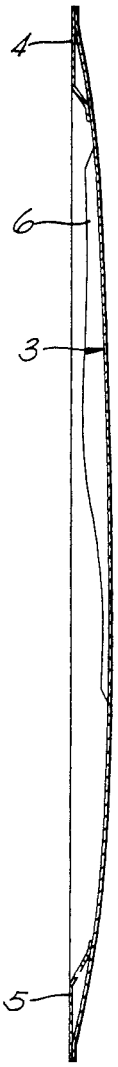
FIG. 8 is a section taken on the central longitudinal axis Y—Y of FIG. 7.
Figure 9:
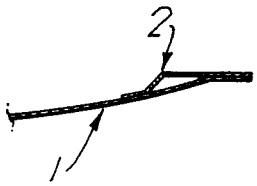
FIG. 9 is a section taken on the line E—E of FIG. 1, FIGS. 10 and 11 are sections taken respectively on lines G—G and H—H of FIG. 7.
Figure 10:
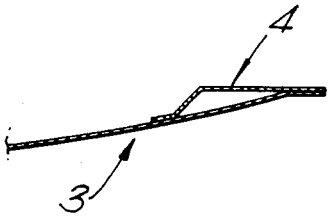
Figure 11:
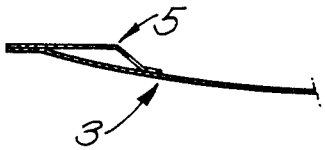
Figure 12:
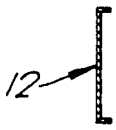
FIG. 12 is a section taken on line K—K of FIG. 1.
Figure 13:
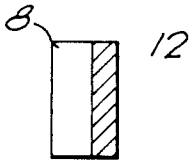
FIG. 13 is a section taken on line J—J of FIG. 1.

With reference to the drawings, a violin 25 is manufactured by fabricating an acoustic box 20 comprising a front plate 3, (FIG. 7), a back plate 1 (FIG. 1) and side pieces 11, 12, 13 (FIG. 15) joining the front plate 3 to the back plate 1. Mounted within the acoustic box 20 is a bass bar 6, (FIG. 7). All the components 1, 2, 3, 6, 11, 12, 13 are fabricated from sheet material composed of substantially unidirectionally orientated man-made fibres set in a matrix of resin, the alignment of the fibres being substantially parallel to the central, longitudinal axis (Z—Z) of the acoustic box 20.

Figure 15:
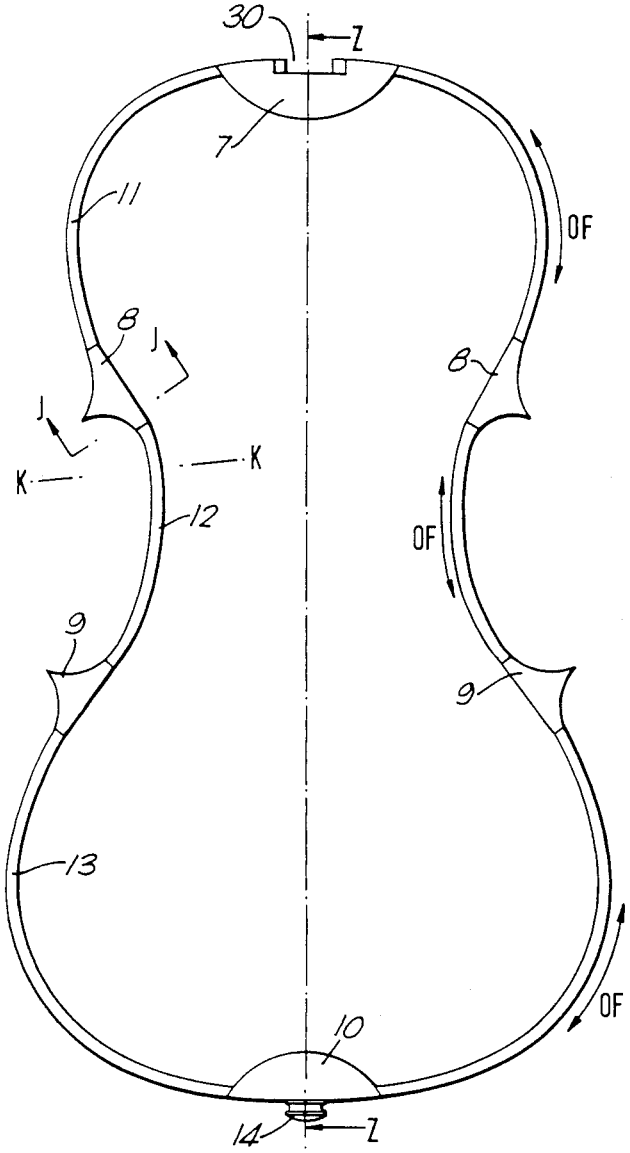
FIG. 15 is a view looking inside the acoustic box of the violin, with the front and back plate assemblies thereof removed.
Figure 16:
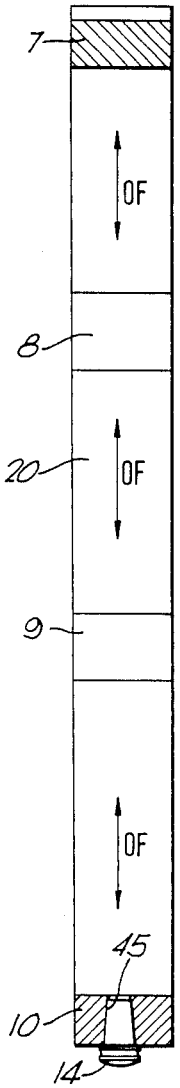
FIG. 16 is a section taken on the central longitudinal axis Z—Z of FIG. 15, FIGS. 17 and 18 are fragmentary side and front views of the completed violin.

As best seen from FIGS. 15 and 16, the acoustic box 20 comprises side pieces 11, 12, 13 (two of each), interconnected by shaped blocks 7, 8, 9, 10.

The back plate 1 (FIG. 1) incorporates a reinforcing structure 2 comprising upper and lower, transverse-disposed torsion elements *2a, 2b* linked by a central reinforcing element *2c* positioned along the central, longitudinal axis X—X of the back plate. By this arrangement the thickness of the material from which the back plate is moulded can be kept to a low value. Furthermore, the mass centres of the flanks of the upper and lower bouts as delineated by the side pieces 11 and 13 (FIG. 15) are brought nearer to the torsional axis Z—Z (FIG. 15) of the acoustic box 20.

Referring to FIG. 7, the front plate 3 incorporates upper and lower transverse-disposed reinforcing elements 4, 5 plus a bass bar 6 cantilevered to the reinforcing element 4.

The reinforcing elements 4, 5 also provide mountings for blocks 7, 10, used to interconnect the side pieces 11, 12, 13.

The bass bar 6 (FIG. 7), being fabricated from the unidirectional fibre material, possesses elastic properties which exercise a decisive influence on the potential for musical performance of the violin 25.

Figure 1:
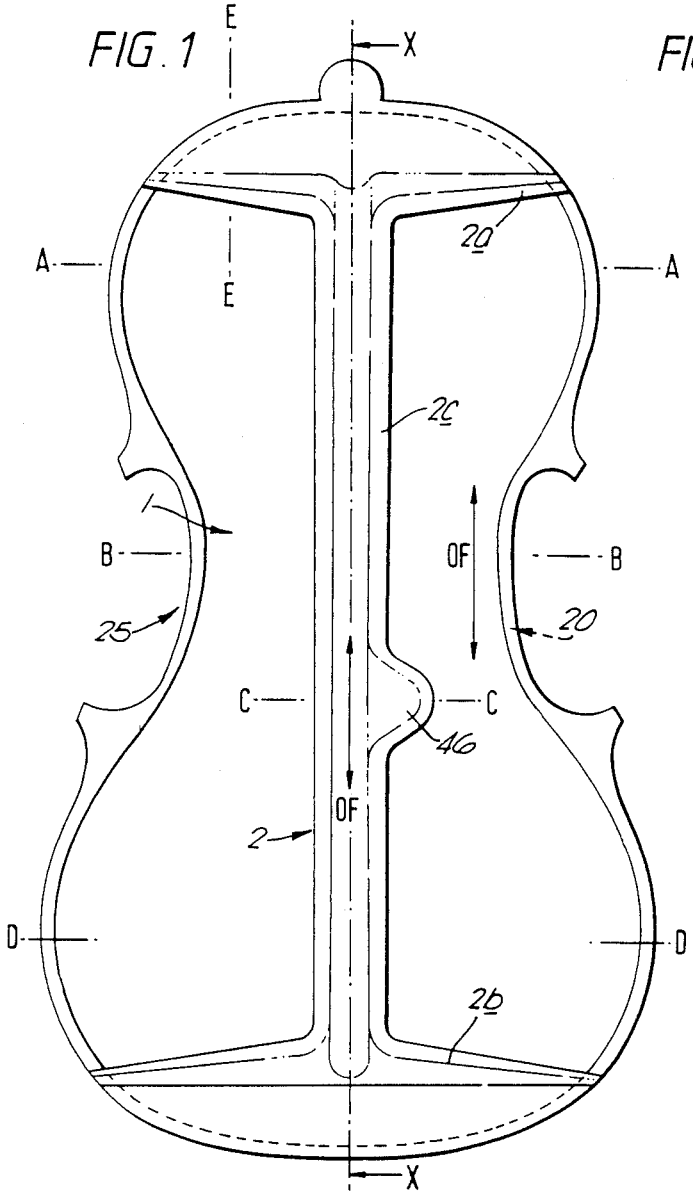
FIG. 1 is a view of a sub-assembly, comprising the back plate of a violin together with reinforcing structure, viewed from inside the acoustic box of the violin.
Figure 2:
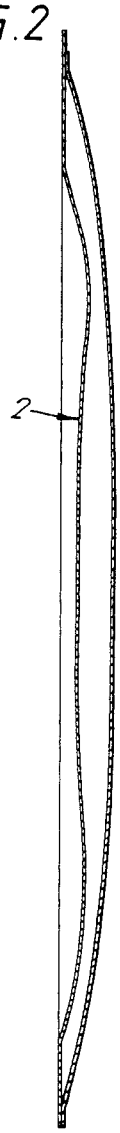
FIG. 2 is a section taken on the longitudinal central axis X—X of FIG. 1, FIGS. 3, 4, 5 and 6 are sections taken on the lines A—A, B—B, C—C and D—D respectively of FIG. 1.
Figure 3:
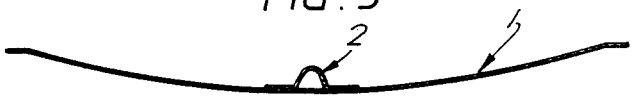
Figure 4:
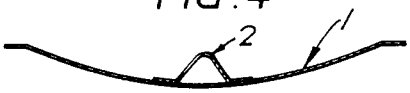
Figure 5:
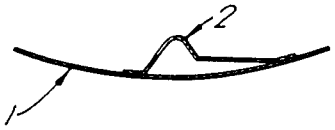
Figure 6:
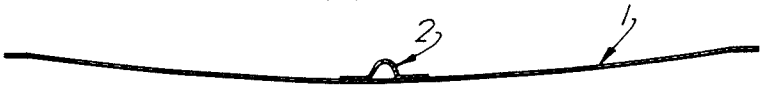
Figure 14:
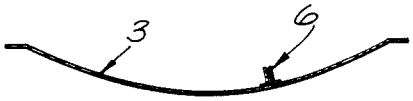
FIG. 14 is a section taken on line F—F of FIG. 7.
Figure 17:
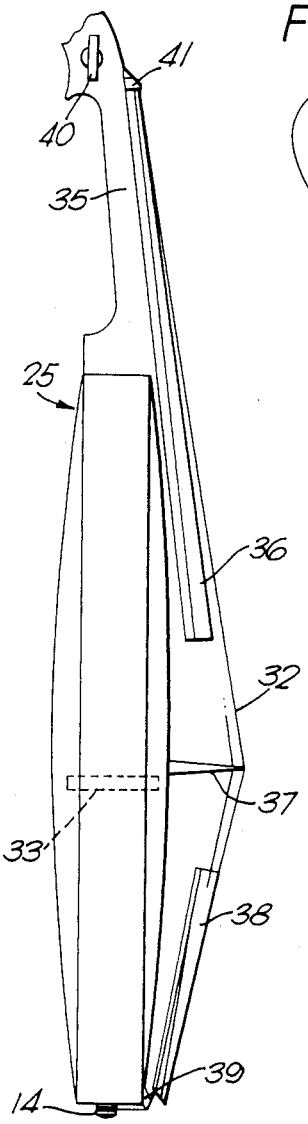
Figure 19:
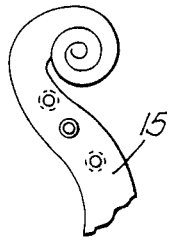
FIG. 19 is a side view of the upper end of the neck piece.
Figure 18:
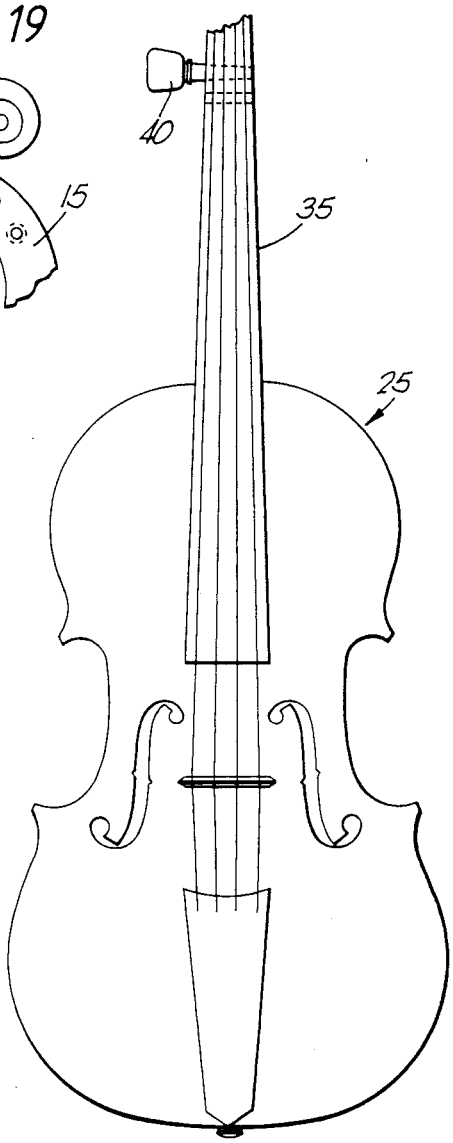

The sound post 33 (FIG. 17) is disposed on a dimple 46 (FIG. 1).

The form of the front and back plates 3, 1, incorporating their reinforcing elements 2, 4 and 5, tends to concentrate, by a build-up in laminations, (as described hereinafter), weight on the central, longitudinal axis Z—Z of the acoustic box 20. This arrangement results in favourable stiffness of the acoustic box 20 in respect of bending and torsion forces generated when the violin 25 is played.

The orientation of the man-made fibres in each component using such fibres is shown on the drawings by arrows O.F. In the front and back plates 3, 1, and in their reinforcement, the orientation is substantially parallel to the central longitudinal axis (Z—Z) of the acoustic box. In each of the six side pieces 11, 12, 13 (two off each) it is substantially parallel to their longer sides. (See FIGS. 15 and 16). In all these components there is additionally a lamination of sparsely distributed, randomly oriented carbon fibres of the order of 20 to the square centimeter.

With further reference to the drawings, manufacture of a violin according to the invention will now be described. All the component parts, with the exception of blocks 7, 8, 9 and 10, are fabricated from a pre-impregnated unidirectional warp sheet of carbon fibre set in a bonding matrix of epoxy resin. This serves as a laminate that can be made up to produce sheets that differ in thickness. A suitable laminate is produced and marketed by the Carbon Fibres Unit of Courtaulds plc, Coventry, England under the Mark "GRAFIL". One example of "GRAFIL" sheet material is as follows:

Carbon fibre specification, "GRAFIL" HM-S.

Thickness of laminate, 0.17 m/m.

Resin specification, "Shell Epicote 828/MNA/BDMA".

Carbon Fibre content, 70% by volume.

The sheet material also includes sparsely distributed, randomly orientated, carbon fibres of the order of 20 fibres/square centimeter.

BACK PLATE 1

The back plate 1 of the violin is fabricated from the "GRAFIL" material, and is made up of six laminations of the material, to a total thickness of about 1.0 mm, the fibres of all the sheets being substantially unidirectional. The stages of manufacture are as follows:

(1) An oversize blank is cut from a single sheet using a blanking tool mounted in a stamping press.

(2) Six such blanks are cut.

(3) The blanks are stacked one upon another to form the required laminations.

(4) The stacked laminations are placed in an autoclave using a hollow mould that is a replica of the outside face of the back plate of a traditional violin, and the resin in the laminations partly cured, so as to form the back plate.

(5) The moulded back plate is removed from the autoclave in its partly cured state and is then trimmed to the required size, using a trimming tool mounted in a stamping press.

(6) The partly cured back plate is clamped between the outer and inner halves of a two-part mould. The mould is then placed in a heated oven whereby resin curing is completed. Subsequently, the mould is removed from the oven and the finished back plate withdrawn from the mould.

BACK PLATE REINFORCING STRUCTURE 2

The back plate reinforcing structure 2 is fabricated from a sheet 0.85 mm in thickness, comprising five laminations of "GRAFIL" material. All the carbon fibres of the sheets are oriented in a substantially unidirectional manner. The remaining stages of manufacture are the same as for the back plate 1.

FRONT PLATE 3

The front plate 3 is fabricated from "GRAFIL" sheet material 0.85 mm thick, comprising five laminations of the material. The first five stages of manufacture are the same as those used for construction of the back plate 1, except that only five laminations are used. Also a different mould. Thereafter:

(6) Using a drilling jig, holes are drilled in the semi-cured plate, located at what will be ends of the sound holes.

(7) Using cutting tools mounted in a stamping press, each sound hole is cut out in a two-stage operation.

(8) The front plate is trimmed to its finished size using a trimming tool mounted in a stamping press.

(9) The semi-cured plate is clamped between the outer and inner halves of a two-part mould. It is then placed in a heated oven whereby the resin curing process is completed. Subsequently, the mould is removed from the oven and the finished front plate withdrawn from the mould.

FRONT PLATE REINFORCING STRUCTURES 4, 5

The front plate reinforcing structures 4 and 5 are also made from the same five lamination unidirectional "GRAFIL" sheet material to a total of 0.85 mm in thickness. The stages of manufacture are as follows:

(1) Blanks of a finished size are made from blanking tools mounted in a stamping press.

(2) The blanks are placed in two-part moulds and the two halves of each mould clamped together. The moulds are then placed in a heated oven until the resin content of the blanks is fully cured in situ.

SIDE PIECES 11, 12, 13

Blanks of a finished size are produced from blanking tools mounted in a stamping press. Two blanks of "GRAFIL" material are required for each of the side pieces 11, 12, 13, and the laminations for each side piece are brought together with the carbon fibre orientation in one lamination disposed at 15° to the orientation of the other. (This is to prevent splitting in the moulding process).

Although the carbon fibres of the two laminations are disposed at 15° to each other, as this angle is small, the fibres can be said to be disposed substantially unidirectionally.

The laminations are then placed in a two-part mould, the mould halves clamped together and the mould placed in a heated oven where the resin content of the sheets is cured as before.

BASS BAR 6

The bass bar 6 is made in two identical halves, *6a*, *6b*. Blanks for each half are produced using a blanking tool mounted in a stamping press, one sheet of "GRAFIL" material for each half. The two laminations, (carbon fibre orientation substantially unidirectional), are then placed in a two-part mould, the halves of which are clamped together and the mould placed in a heated oven until the resin content of the laminations is cured.

ASSEMBLY OF THE VIOLIN

Back Plate and Reinforcement Sub-Assembly

Using an assembly jig, the back plate 1 and the reinforcing structure 2 are brought together, the mating surfaces of the two components having been coated beforehand with an epoxy resin adhesive. The jig and the components 1, 2 are then placed in a heated oven whereby the adhesive is cured and the components bonded together.

The Bass Bar Assembly

Using an assembly jig, the two halves *6a, 6b* of the bass bar 6 are brought together, the mating surfaces having been coated beforehand with an epoxy resin adhesive. The jig and the two halves are placed in a heated oven whereby the adhesive is cured and the components bonded together.

The Front Plate Sub-Assembly

Using an assembly jig, the front plate 3, the reinforcing structures 4, 5 and the bass bar 6 are brought together, the mating surfaces of all the components having been coated beforehand with an epoxy resin adhesive. The jig and the components are placed in a heated oven whereby the adhesive is cured and all the components bonded together.

The Side Pieces 11, 12, 13 and Block 7, 8, 9, 10 Assembly

Using an assembly jig, the blocks 7 and 10, as well as the blocks 8 and 9 (two off each), are assembled with the side pieces 11, 12, 13, the mating surfaces of all the components having been treated beforehand with an epoxy resin adhesive. The components are then clamped together and the jig placed in a heated oven whereby the resin is cured and the components bonded together.

Before assembly, the block 7 will be formed with a dove-tail recess 30 (FIG. 15).

Final Assembly of the Acoustic Box 20

Using an assembly jig, the front plate sub-assembly, the back plate sub-assembly and the side pieces and block assembly are all clamped together, the mating surfaces of all the components having been treated beforehand with an epoxy resin adhesive. The jig and components are placed in a heated oven whereby the adhesive is cured and the components bonded together.

Neck and Finger Board Sub-Assembly

The neck 35 (FIG. 17) and the finger board 36 are located and clamped together, the mating surfaces having been coated beforehand with an epoxy resin adhesive. The sub-assembly is then placed in a heated oven whereby the adhesive is cured and the components bonded together.

In the case of this particular sub-assembly, it can be assumed that the neck 35 and finger board 36 have been made of traditional material, ebony and/or acer, using traditional craft techniques. Alternatively, the components of the sub-assembly may be made of plastics material, using injection moulding techniques.

Whatever techniques or materials have been used to make the neck, one end of the neck will have recess 30 in the block 7. Using an assembly jig, the neck and finger board sub-assembly is fitted in the recess 30 and secured in place with an epoxy resin adhesive which is subsequently cured in a heated oven.

Final Assembly and Stringing Up

The nut (41), saddle (39), bridge (37), sound post (33), tail piece (38), gut strings (32), button (14) and pegs (40) can all be purchased from most musical instrument dealers and suppliers. It will be appreciated that an instrument of otherwise excellent potential for musical performance can be spoiled by badly fitting bridge and sound post and/or the use of cheap strings. The fitting of the bridge and sound post requires considerable craft skill and that degree of 'know-how' that comes from long practice. With the sound post 33 in position, the pegs 40 fitted to the peg-box, the tail piece gut fitted to the tail piece 38, the button 14 placed in the hole 45 formed in the block 10, the strings 32 can be attached to the tail piece, the tail piece gut looped over the button, the string ends placed in the holes provided in the pegs and the strings tensioned by turning the pegs having first placed the bridge in position in relationship to the sound post.

I claim:

1. A violin manufactured by fabricating an acoustic box from components comprising a front plate, a back plate, and side pieces, joining the front plate to the back plate, and, mounting within the acoustic box, a bass bar, characterized in that all of these components are fabricated from sheet material composed essentially of substantially unidirectionally oriented man-made fibers set in a matrix of resin, the alignment of the fibers being substantially parallel to the central, longitudinal axis of the acoustic box.

2. A violin according to claim 1; characterized in that the man-made fibers have a Young's Modulus of elasticity specific gravity quotient ($gn/m^2$ divided by specific gravity) of at least 50.

3. A violin according to claim 2, characterized in that the man-made fibers are carbon fibers, or boron fibers.

4. A violin according to claim 1, characterized in that the resin is an epoxy resin.

5. A violin according to claim 1, characterized in that a substantial proportion of the weight of material necessary to the stiffness of the structure in respect of bending and torsion, is concentrated on the central longitudinal axis of the acoustic box.

6. A violin according claim 1, characterized in that the back plate is provided with a central, longitudinally-extending reinforcing structure comprising transverse upper and lower elements which provide mountings for blocks at each end of the acoustic box, the reinforcing structure being composed of substantially unidirectionally oriented man-made fibers set in a matrix of resin, the alignment of the fibers being substantially parallel to the central, longitudinal axis of the acoustic box.

7. A violin according to claim 1, characterized in that the front and back plates are fabricated by a build-up of the shaped laminations, and whereby weight is concentrated on the central, longitudinal axis of the acoustic box.

8. A violin according to claim 1, characterized in that the front plate is provided with upper and lower transverse reinforcing elements composed of substantially unidirectional oriented man-made fibers set in a matrix of resin, the alignment of the fibers being substantially parallel to the central, longitudinal axis of the acoustic box.

9. A violin according to claim 8, characterized in that the bass bar is attached to the upper transverse element.

10. A method of manufacturing a violin by fabricating an acoustic box from sheet material composed essentially of substantially unidirectionally oriented man-made fibers set in a matrix of resin; said box having the components comprising a front plate, a back plate, and side pieces, joining the front plate to the back plate, and mounting within the acoustic box, a bass bar, characterized in that all of these components are fabricated with the alignment of the fibers being substantially parallel to the central, longitudinal axis of the acoustic box, and the front plate and back plate of the acoustic box are fabricated by building up and shaping laminations to concentrate their weights on the central longitudinal axis of the acoustic box.

11. A method of manufacturing a violin by fabricating an acoustic box from sheet material composed essentially of substantially unidirectionally oriented man-made fibers set in a matrix of resin; said box having the components comprising a front plate, a back plate, and side pieces, joining the front plate to the back plate, and mounting within the acoustic box, a bass bar, characterized in that all of said components are fabricated with the alignment of the fibers being substantially parallel to the central, longitudinal axis of the acoustic box, and characterized by providing reinforcing structure on the central axes of the front and back plates of the acoustic box to provide, together with said plates, stiffness of the acoustic box in respect of bending and torsion.

* * * * *